US010905272B2

(12) United States Patent
Conaway

(10) Patent No.: US 10,905,272 B2
(45) Date of Patent: Feb. 2, 2021

(54) MAIL KEYPER

(71) Applicant: Linda Conaway, Wall, NJ (US)

(72) Inventor: Linda Conaway, Wall, NJ (US)

( * ) Notice: Subject to any disclaimer, the term of this patent is extended or adjusted under 35 U.S.C. 154(b) by 0 days.

(21) Appl. No.: 16/696,164

(22) Filed: Nov. 26, 2019

(65) Prior Publication Data

US 2020/0237131 A1 Jul. 30, 2020

Related U.S. Application Data

(60) Provisional application No. 62/796,180, filed on Jan. 24, 2019.

(51) Int. Cl.

| | |
|---|---|
| ***A47G 29/12*** | (2006.01) |
| ***A47G 29/122*** | (2006.01) |
| ***A47G 29/124*** | (2006.01) |

(52) U.S. Cl.

CPC ... *A47G 29/12095* (2017.08); *A47G 29/1212* (2013.01); *A47G 29/1248* (2017.08); *A47G 2029/1228* (2013.01)

(58) Field of Classification Search

CPC combination set(s) only.

See application file for complete search history.

(56) References Cited

U.S. PATENT DOCUMENTS

| | | | | |
|---|---|---|---|---|
| 6,831,558 | B1 | 12/2004 | Andrew | |
| 7,337,944 | B2 | 3/2008 | Devar | |
| 9,336,667 | B2 | 5/2016 | Hammoud | |
| 2005/0104730 | A1 | 5/2005 | Yang | |
| 2006/0113368 | A1* | 6/2006 | Dudley | A47G 29/141 232/31 |
| 2012/0158606 | A1 | 6/2012 | Moudy | |
| 2015/0359371 | A1 | 12/2015 | Giovinco | |
| 2016/0292945 | A1 | 10/2016 | Waller | |
| 2017/0326598 | A1* | 11/2017 | Chelian | A47G 29/1214 |

FOREIGN PATENT DOCUMENTS

| | | | |
|---|---|---|---|
| CA | 2841306 | A1 | 7/2015 |

* cited by examiner

*Primary Examiner* — Thomas S McCormack

(74) *Attorney, Agent, or Firm* — Gearhart Law LLC

(57) ABSTRACT

A smart and secure mailbox includes a mailbox and a secured storage. The mailbox and the secured storage are connected through a shared section. The shared section encloses an automated flap. The shared section also integrates a weight sensor. Upon a delivery of a mail, the weight sensor provides an activation signal which triggers the automated flap. The automated flap activates and provides a gap between the mailbox and the secured storage. The delivered mail falls through the gap. Upon a placement of the delivered mail within the secured storage, the automated flap closes which secures the delivered mail within the secured storage.

15 Claims, 5 Drawing Sheets

MAIL KEYPER

CLAIM OF PRIORITY

This application claims priority under 35 U.S.C. § 119 to U.S. provisional application No. 62/796,180 filed on Jan. 24, 2019 in the United States Patent and Trademark Office, the entire disclosure of which is incorporated herein by reference.

FIELD OF THE EMBODIMENTS

The field of the present invention and its embodiments relate to a smart and secure mailbox device with a mailbox and a secured storage section that are connected through an automated flap for securing a delivered mail within the secured storage section.

BACKGROUND OF THE EMBODIMENTS

Online shopping has provided a gateway to a shopping experience previously unimagined. Expansive product ranges are available to consumers for purchase through online shopping. Purchased products are delivered to the consumer by governmental and private mail delivery organizations. Delivery organizations continue to use legacy mail delivery schemes that existed prior to the online shopping experience. As a result of the antiquated delivery schemes, mail delivery to the consumer is insecure.

Mail delivery is inherently insecure due to a necessity to provide an access to a container such as a mailbox to a delivery person. Although, locked mailboxes exist, such solutions to secure delivered mail are impractical at a large scale. Locked mailboxes are impractical because of the necessity to carry a key or an access device associated with each of the locked mailboxes serviced by the delivery person(s). Below examples may include schemes that attempted to secure insecure mail delivery to consumer.

For instance, U.S. Pat. No. 6,831,558 B1 pertains to a mailbox operated signal device that has a motion detector attached to an inside of a mailbox which activates a light and a speaker to alert a resident that mail is delivered into the mailbox.

U.S. Pat. No. 7,337,944 B2 pertains to a universal delivery and collection box unit. The box unit includes a mail compartment accessible by a door and a storage compartment accessible by another door. The storage compartment is separate from the mail compartment and is used to deliver and store larger parcels.

U.S. Pat. No. 9,336,667 B2 pertains to an electronic mailbox system. The electronic mailbox system houses an inner cavity for holding mail, an electric-operable lock system to access the mailbox, a mail sensor to detect delivery of mail, and a control scheme to manage the mailbox.

U.S. 2005/0104730 A1 pertains to an intelligent mailbox that includes a video camera, and a remote keyboard, among other components to resolve short comings of the traditional signature based delivery operations.

U.S. 2015/0359371 A1 pertains to a mail notification device to alert when a mail is received. The notification device includes a sensor to detect delivery of the mail.

Various systems and methodologies are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE EMBODIMENTS

The present invention and its embodiments relate to a smart and secure mailbox device that is configured to secure a delivered mail. In an example embodiment of the present invention, the smart and secure mailbox device may include a mailbox component that is connected to a secure storage component through a shared section. The shared section may form a bottom section of the mailbox component. The shared section may also form a top section of the secured storage component. Furthermore, the shared section includes a weight sensor. The weight sensor is configured to generate an activation signal in response to a delivered mail. In addition, an automated flap is enclosed by the shared section. The automated flap is configured to activate (and provide a gap in the shared section) upon receiving the activation signal from the weight sensor.

In another embodiment of the present invention, a smart and secure mailbox system is described. The smart and secure mailbox system may include a mailbox component. The mailbox component may include a door accessible to a delivery person providing the delivered mail. A secured storage component is connected to the mailbox component through a shared section. The shared section includes a weight sensor configured to generate an activation signal in response to a delivered mail. Furthermore, the shared section encloses an automated flap. In addition, a controller may be connected to the weight sensor and the automated flap. The controller is configured to activate the automated flap upon receiving the activation signal from the weight sensor.

In yet another embodiment of the present invention, a method of managing a delivered mail securely with a smart and secure mailbox device is described. The delivered mail may be received within a mailbox component. The mailbox component may be connected to a secured storage component through an automated flap. Next, an activation signal from a weight sensor may be detected. The weight sensor may be integrated into the mailbox component. In response to the activation signal, the automated flap may be activated. The delivered mail may fall into the secured storage component through the gap created by the automated flap. The delivered mail may be secured within the secured storage component by instructing the automated flap to close.

It is an object of the present invention to provide a smart and secure mailbox device that secures a delivered mail.

It is an object of the present invention to provide a smart and secure mailbox device that informs an authorized user about attributes of the delivered mail such as a label/categorization, a time of delivery, and/or an image or video stream of the delivered mail.

It is an object of the present invention to provide a smart and secure mailbox device that informs the authorized user of a filled state of a secured storage component to prompt the authorized user to empty the secured storage component.

It is an object of the present invention to provide a smart and secure mailbox device that allows the authorized user keyless access to the secured storage component.

These and other features, aspects and advantages of the present invention will become better understood with reference to the following drawings, description and claims.

DESCRIPTION OF THE PREFERRED EMBODIMENTS

Figure 1:
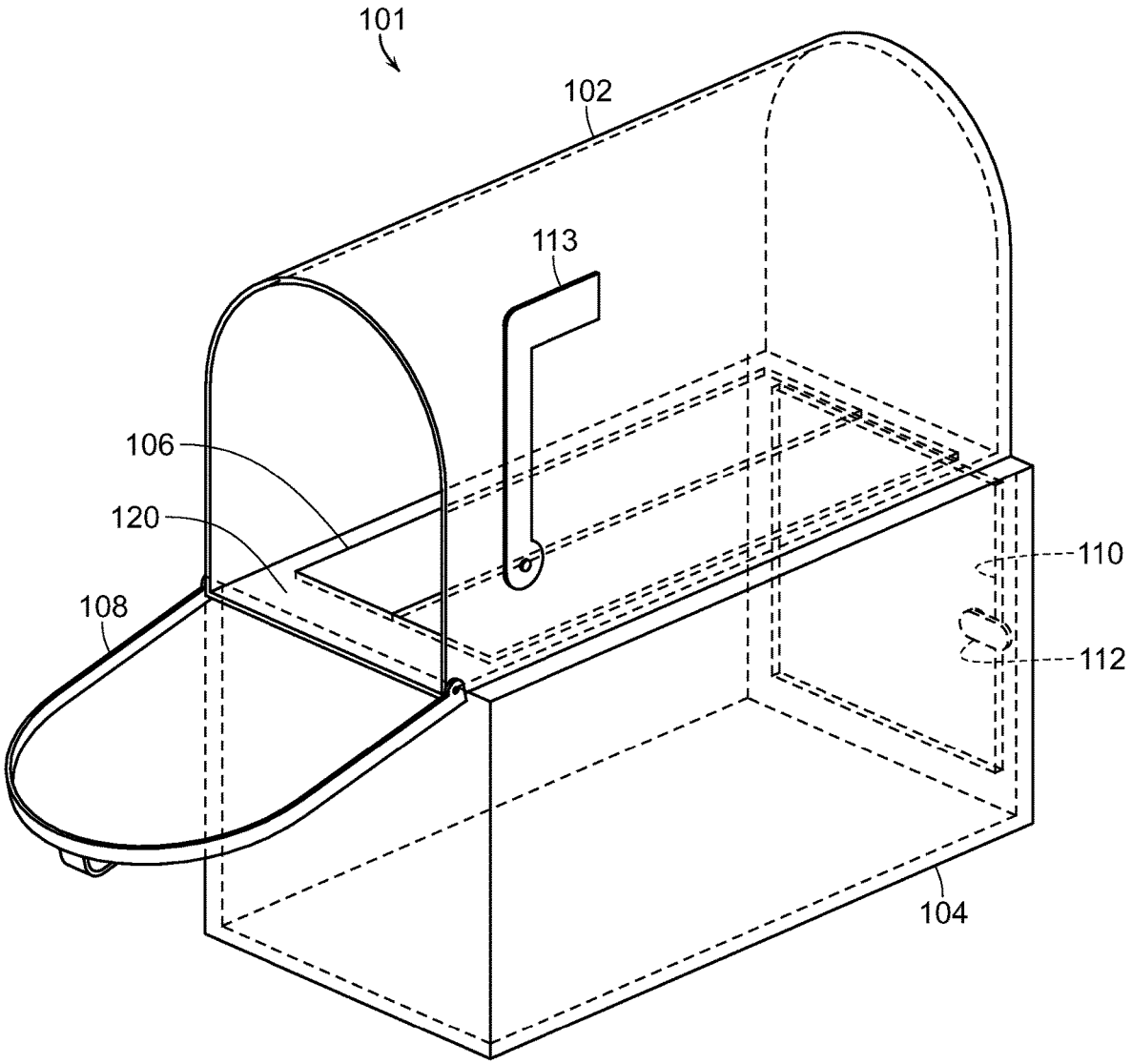
FIG. 1 shows a side view of an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 shows a smart and secure mailbox device 101 with two primary components. The smart and secure mailbox device 101 may include a mailbox component 102 and a secured storage component 104. The mailbox component 102 may include a container with an open section. The open section may be covered by a door 108. An example of the door 108 may include a flap or a lid that is connected to the open section of the mailbox component 102 with a hinge or other scheme.

In an example scenario, a delivery person may have access to the mailbox component 102 through the door 108. The delivery person may deliver a mail by opening the door 108 and inserting the mail inside the mailbox component 102. The mail may include a variety of deliverable items including an envelope, a package, a parcel, or a box, among other things. The mailbox component 102 may also include configurable parts to allow the delivery person to configure visual or other cues associated with a delivery process. For example, the delivery person may raise or lower a flag 113 on the mailbox component 102 to indicate a status of a delivery.

The mailbox component 102 may be connected to the secured storage component 104 through a shared section 120. In an example scenario, the shared section 120 may form an entirety or a portion of a bottom section of the mailbox component 102. The shared section 120 may also form an entirety or a portion of a top section of the secured storage component 104.

The shared section 120 may enclose an automated flap 106. The automated flap 106 may form an entirety or a portion of the shared section 120. The automated flap 106 may include two doors that slide, open, or close based on an operation of an actuator (or actuators). Alternatively, an example of the automated flap 106 may include a single door that slides, opens, or closes based on an operation of an actuator. Other schemes may exist for the operation of the automated flap 106. However, all embodiments result in a gap in the shared section 120 during the operation of the automated flap 106. In an example scenario, the automated flap 106 is configured to open upon receiving a delivery of mail. The delivered mail may fall into the secured storage component 104 through the gap in the shared section 120. Next, the automated flap 106 may close. Closing of the automated flap 106 may secure the delivered mail in the secured storage component 104.

The secured storage component 104 may be accessible through a secured door 110. An authorized person may be allowed to open or close the secured door 110 through an interaction with a locking mechanism 112. Examples of the locking mechanism may include a lock and key pair, or a smart lock, among others.

The mailbox component 102 and the secured storage component 104 may be connected through schemes other than the shared section 120. In an example scenario, the mailbox component 102 may be connected to the secured storage component 104 through an intermediary component. In an example scenario, the intermediary component may be placed below the mailbox component 102 and above the secured storage component 104 that would allow the delivered mail to fall through the intermediary section from the mailbox component 102 into the secured storage component 104. Alternatively, the mailbox component 102 and the secured storage component 104 may be placed in different locations and connected through a transportation scheme. Examples of the transportation scheme may include as a vacuum based transportation or other scheme for transporting the delivered mail from the mailbox component 102 to the secured storage component 104.

Figure 2:
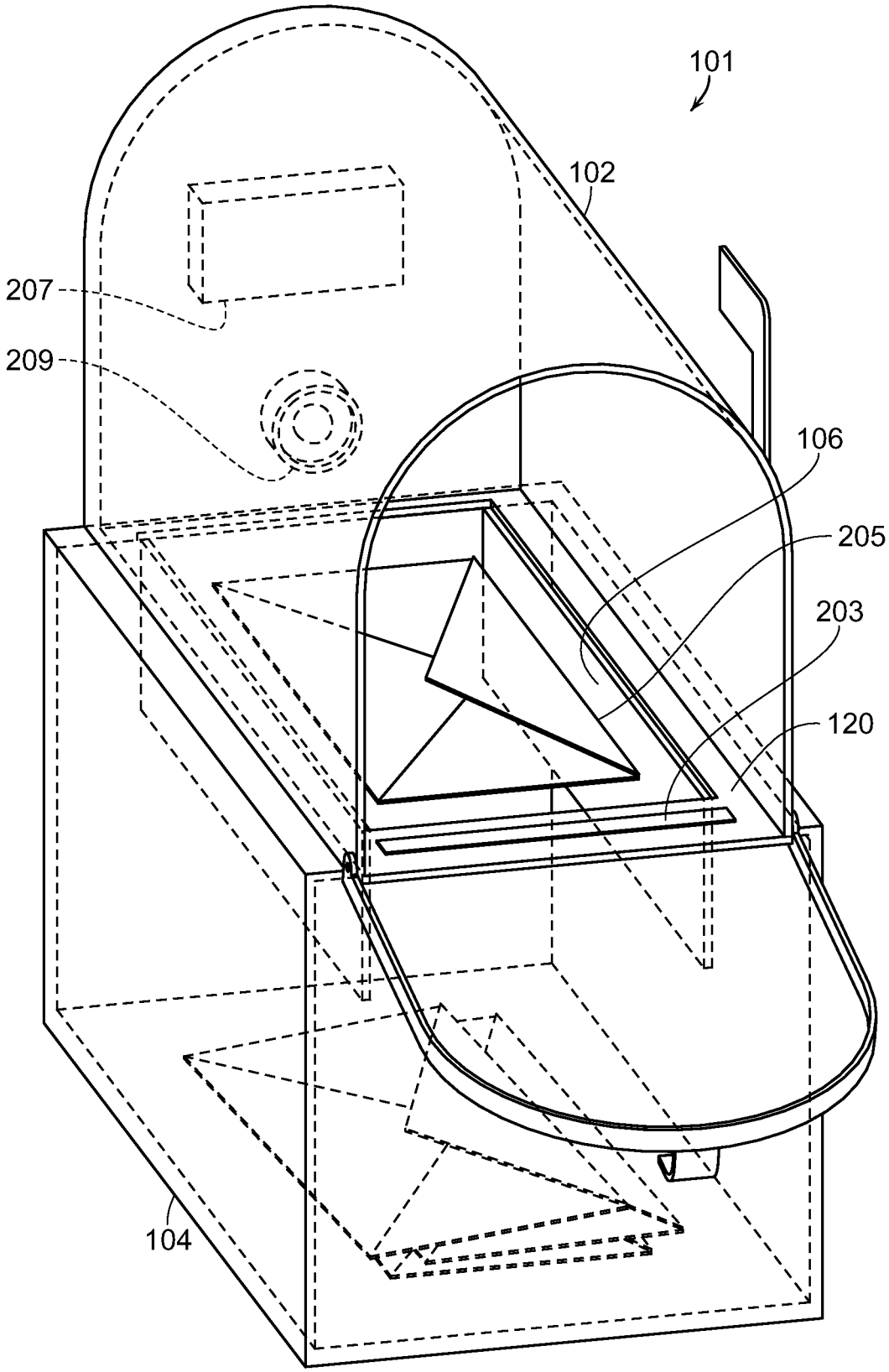
FIG. 2 shows a front view of an embodiment of the present invention.

FIG. 2 shows a front view of the smart and secure mailbox device 101. In an example scenario, a delivery person may access the mailbox component 102 and provide a delivered mail 205. The shared section 120 may form a bottom section of the mailbox component 102. The delivered mail 205 may be placed on the shared section 120 by the delivery person. The shared section 120 may have a weight sensor 203 that may detect a placement of the delivered mail 205. Upon detecting the delivered mail 205, the weight sensor may transmit an activation signal to a controller 207. The controller 207 may include an integrated circuit that processes a signal from the weight sensor 203 and activates/deactivates the automated flap 106.

Upon receiving the activation signal from the weight sensor 203, the controller 207 may instruct the automated flap 106 to activate. The automated flap 106 may activate and create a gap in the shared section 120. The delivered mail 205 may fall through the gap in the shared section 120 and rest in the secured storage component 104. A bottom section of the secured storage component 104 may be composed of soft or padded material to prevent damage to the delivered mail 205 during a fall from the mailbox component 102.

The controller 207 may instruct the automated flap 106 to deactivate or close upon a placement of the delivered mail 205 into the secured storage component 104. The instruction to deactivate or close the automated flap 106 may be transmitted based on a predetermined time period (such as 1 second or more). The predetermined time period may allow the delivered mail 205 to complete the fall into the secured storage component 104. Alternatively, a sensor integrated into the secured storage component 104 may signal the controller 207 regarding the placement of the delivered mail 205 into the secured storage component 104. Upon receiving the signal from the sensor, the controller 207 may instruct the automated flap 106 to deactivate or close. In yet another alternative embodiment, the automated flap 106 may manage activation and/or deactivation operations locally with included circuitry and connections to sensors (such as the weight sensor 203). The automated flap 106 may deactivate or close automatically (without input from the controller 207) based on a predetermined time period scheme or a scheme involving a signal from a sensor (detecting a placement of the delivered mail 205 into the secured storage component 104).

The mailbox component 102 may also include a camera 209. The camera 209 may be configured to capture and transmit an image and/or a video stream of the delivered mail 205. In an example scenario, the controller 207 may instruct the camera 209 to capture the image and/or video stream of the delivered mail 205 upon receiving the activation signal from the weight sensor 203. The camera 209 may capture and transmit the image and/or video stream of the delivered mail 205 to the controller 207. Next, the controller 207 may instruct the automated flap 106 to activate, to place the delivered mail 205 into the secured storage component 104. The controller 207 may also transmit the image and/or the video stream of the delivered mail 205 to an image processing service.

The image processing service may provide functionality to recognize an object in a provided image and/or video stream and label/categorize the object. For example, the image and/or video stream of the delivered mail 205 may include a small box. The image processing service may label/categorize the object as a small box and provide metadata such as shape, dimensions, and/or color information. The image processing service may also recognize writings and/or graphics on the delivered mail 205 and provide label/categorization associated with the writings and/or graphics. The image processing service may be provided locally (for example by a component of the controller 207) or externally (for example by a web service). Alternatively, the camera 209 may process the image and/or video stream with locally available processing resources.

Next, the controller 207 may receive a label for the delivered mail 205 from the image processing service. The controller 207 may generate a notification that includes a time of delivery (associated with the activation signal from the weight sensor 203), the label (from the image processing service or other recognition scheme), and/or the image or video stream of the delivered mail 205. The notification may be transmitted to an authorized user. The authorized user may include an owner of the smart and secure mailbox device 101 or another entity that is granted access privileges to the smart and secure mailbox device 101. The transmission may be directed to a device associated with the authorized user. Schemes to secure the transmission may also be implemented, for example, the content of the notification may be encrypted, among other schemes.

Figure 3:
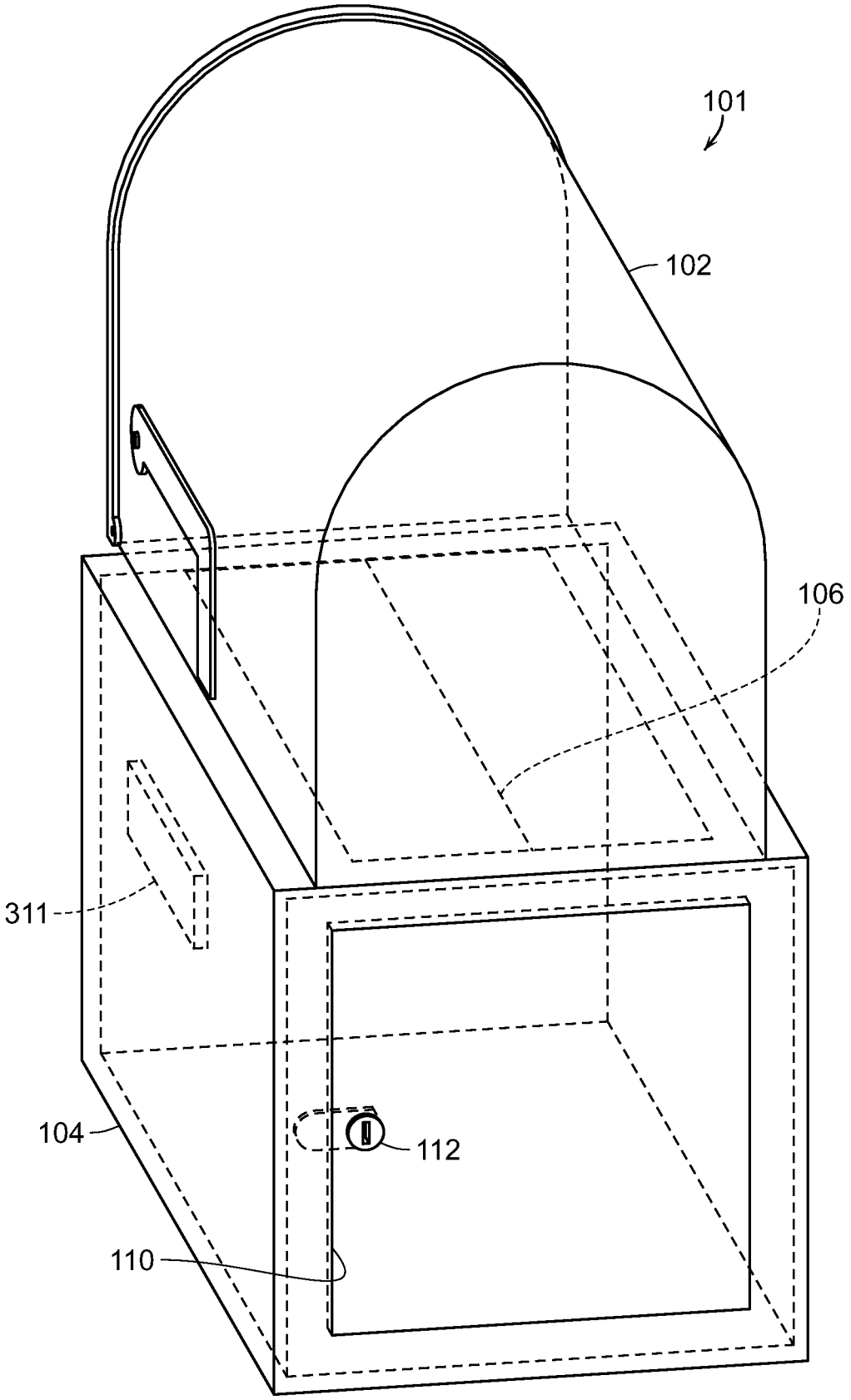
FIG. 3 shows a rear view of an embodiment of the present invention.

FIG. 3 shows a rear view of the smart and secure mailbox device 101. The smart and secure mailbox device 101 may include the mailbox component 102 and the secured storage component 104. The secured storage component 104 may include the secured door 110 that is accessible by an authorized user. Access to the secured storage component 104 is granted to an authorized user through the locking mechanism 112. In an example scenario, the locking mechanism 112 may include a lock and a paired key. The authorized user may lock/unlock the lock using the paired key to open/close the secured door 110. As a result, the authorized user is granted access to contents of the secured storage component 104 which include the delivered mail.

Alternatively, the locking mechanism 112 may include a smart lock. The smart lock may be operable through an authorized device (of an authorized user). The authorized device may be paired with the smart lock to transmit open/close instructions to the smart lock. An example of the authorized device may include a smart phone of the authorized user.

The secured storage component 104 may also include a capacity sensor 311. If activated, the capacity sensor 311 may transmit a filled signal indicating a status of the secured storage component 104 as filled. The capacity sensor 311 may be placed in a location on the secured storage component 104 where insertion of any additional mail above the location will prevent operation of the automated flap 106. A controller associated with the capacity sensor 311 and the automated flap 106 may instruct the automated flap 106 to remain closed once the capacity sensor 311 is activated. As a result, the delivered mail in the secured storage component 104 may remain secure. The controller may also transmit a notification to an authorized user describing the filled state of the secured storage component 104 to prompt the authorized user to empty the secured storage component 104. Alternatively, the capacity sensor 311 may include processing resources and connections to complete tasks associated with the filled status of the secured storage component 104, locally, without a separate controller.

Figure 4:
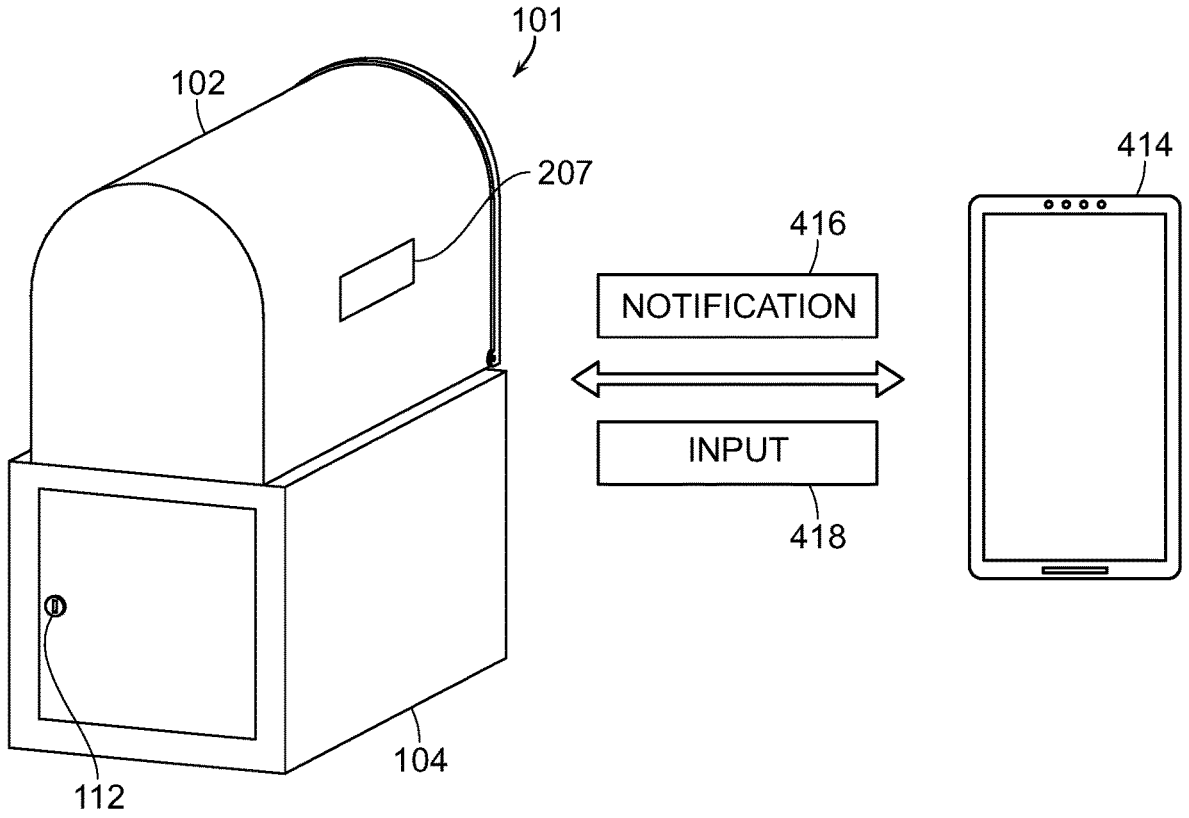
FIG. 4 shows an interaction view of an embodiment of the present invention.

FIG. 4 shows an interaction view between the smart and secure mailbox device 101 and an authorized device such as a smart phone 414. In an example embodiment, the controller 207 may manage various sensors and devices (such as a camera) within the mailbox component 102 and the secured storage component 104. The controller 207 may be integrated into the mailbox component 102. Alternatively, the controller 207 may be integrated into the secured storage component 104 to restrict access to the controller 207.

In an example scenario, the controller 207 may transmit a notification 416 to the smart phone 414. The notification 416 may include attributes of the delivered mail such as a label, a time of delivery, and/or an image or a video stream of the delivered mail. Alternatively, the notification may describe a filled state of the secured storage component 104.

The controller 207 may also receive an input 418 from the smart phone 414. The input 418 may include instructions (transmitted wirelessly) to operate the smart lock 112 on the secured storage component 104 to gain access to the secured storage component 104. The input 418 may include instructions to unlock the smart lock 112 to allow an authorized user access to the secured storage component 104. Alternatively, the input 418 may include instructions to lock the smart lock 112 to secure the secured storage component 104.

Figure 5:
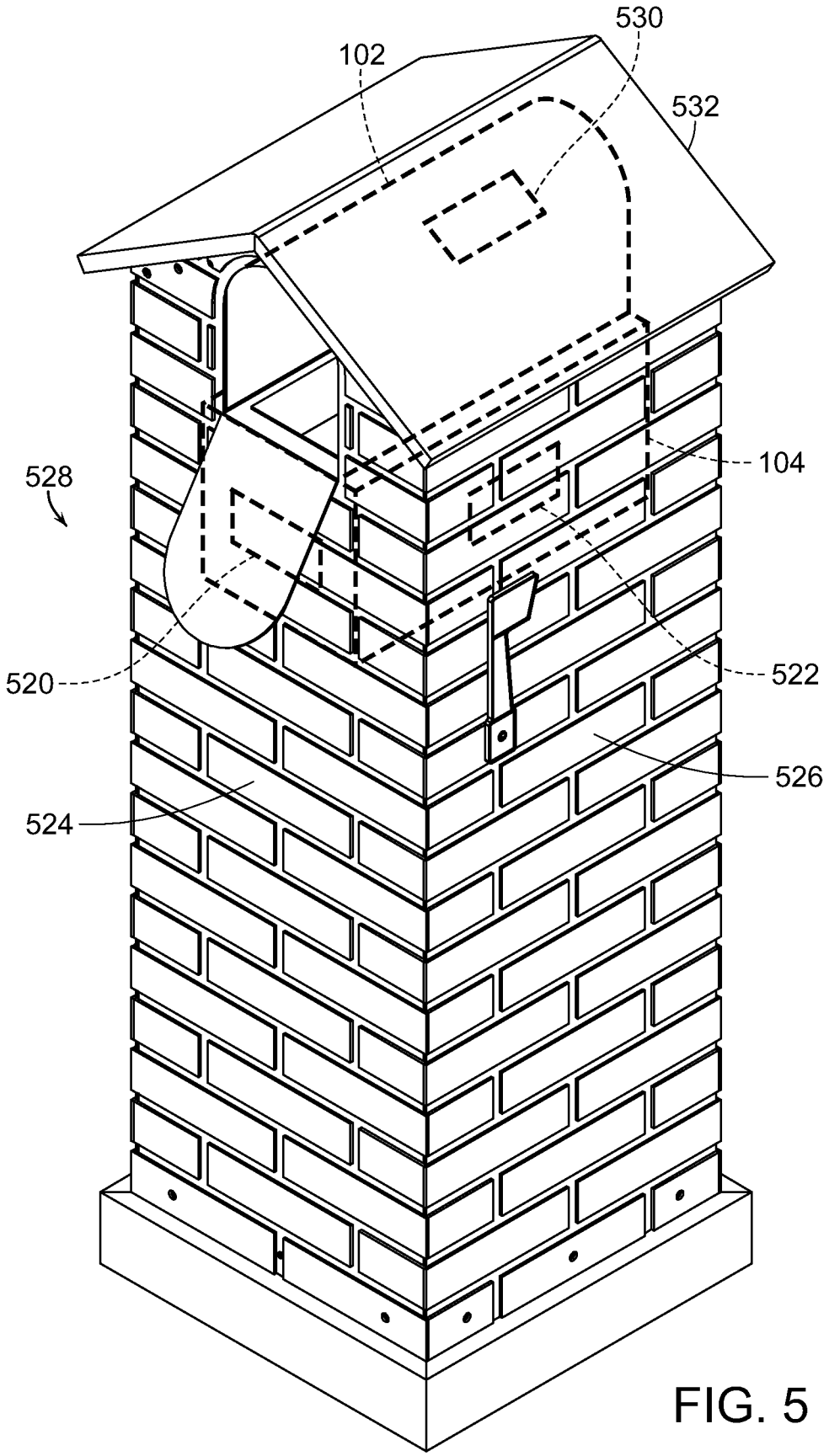
FIG. 5 shows a component view of an external enclosure attachable to an embodiment of the present invention.

FIG. 5 shows a component view of an external enclosure that may be attached to the mailbox device 101. In an example scenario, the mailbox device 101 may be covered with an enclosure 528. The enclosure 528 may include first and second side panels (522 and 524), and/or a top panel 532, among others.

The first and second side and top panels (522, 524, and 532) of the enclosure 528 may be attached to the mailbox device 101 with first, second, and third magnets (520, 522, and 530). For example, the first side panel 524 may be connected to a back and/or a front side(s) of the secured storage component 104 through the first magnet 520 (and other magnet) integrated to the secured storage component 104. Alternatively, the first side panel 524 may be connected to a back and/or a front side(s) of the mailbox component 102 through the first magnet 520 (and other magnet) integrated to the mailbox component 102. The first magnet 520 may attract, attach, and secure the first side panel 524 when in proximity to the secured storage component 104 (or the mailbox component 102). A section or an entirety of the first side panel 524 may include a magnetic material that is oriented to magnetically interact with the first magnet 520.

In another example scenario, the second side panel 526 may be connected to a right and/or a left side(s) of the secured storage component 104 through the second magnet 522 (and other magnet) integrated to the secured storage component 104. Alternatively, the second side panel 526 may be connected to the right and/or a left side(s) of the mailbox component 102 through the second magnet 522 (and other magnet) integrated to the mailbox component 102. The second magnet 522 may attract, attach, and secure the side panel 526 when in proximity to the secured storage component 104 (or the mailbox component 102). A section or an entirety of the second side panel 526 may include a magnetic material that is oriented to magnetically interact with the second magnet 522.

In yet another example scenario, the top panel 532 may be connected to a top side of the mailbox component 102 through the third magnet 530 (and other magnet) integrated to the mailbox component 102. The third magnet 530 may attract, attach, and secure the top panel 532 when in proximity to the mailbox component 102. A section or an entirety of the top panel 532 may include a magnetic material that is oriented to magnetically interact with the third magnet 530.

Alternatively, the first, second, and third magnets (520, 522, and/or 530) may be integrated to the first and/or second side components (524 and/or 526), and/or the top component 532. The enclosure 528 may be attached and secured to the mailbox device when the first, second, and third magnets (520, 522, and/or 530) may be in proximity to magnetic material integrated to the mailbox component 102 and/or the secured storage component 104.

A method of managing a delivered mail securely with a smart and secure mailbox device is described. The delivered mail may be received within the mailbox component. The mailbox component may be connected to a secured storage component through an automated flap. Next, an activation signal from a weight sensor may be detected. The weight sensor may be integrated into the mailbox component. In response to the activation signal, the automated flap may be activated. The delivered mail may fall into the secured storage component through the gap created by the automated flap. The delivered mail may be secured within the secured storage component by instructing the automated flap to close.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A smart and secure mailbox device comprising:

a mailbox component;

a secured storage component coupled to the mailbox component through a shared section, wherein the shared section includes a weight sensor configured to generate an activation signal in response to a delivered mail;

an automated flap enclosed by the shared section, wherein the automated flap is configured to activate upon receiving the activation signal;

one or more side panels configured to magnetically couple to an outer surface of the secured storage component, wherein the one or more side panels completely cover the outer surface of the secured storage component; and a top panel configured to magnetically couple to a top surface of the mailbox component.

2. The device of claim 1, wherein the shared section comprises a bottom section of the mailbox component and a portion of a top section of the secured storage component.

3. The device of claim 1, wherein the automated flap comprises an entirety of the shared section.

4. The device of claim 1, further comprising:

a camera coupled to the mailbox component, wherein the camera is configured to capture and provide an image or video stream of the delivered mail; and a controller coupled to the weight sensor and the camera.

5. The device of claim 4, wherein the controller is configured to:

receive the activation signal form the weight sensor;

instruct the camera to capture the image or video stream of the delivered mail;

receive the image or video stream of the delivered mail from the camera;

transmit the image or video stream of the delivered mail to an image processing service;

receive a label for the delivered mail from the image processing service; and transmit a notification to an authorized user, wherein the notification includes the label, a time of delivery associated with the activation signal, and the image or video stream of the delivered mail.

6. The device of claim 1, wherein the mailbox component includes a door accessible to a delivery person providing the delivered mail.

7. The device claim 1, wherein the storage component includes a secured door accessible to an authorized user through a locking mechanism.

8. The device of claim 7, wherein the locking mechanism includes a lock and a paired key.

9. The device of claim 7, wherein the locking mechanism includes a smart lock operable with a secured transmission emitted by an authorized device of the authorized user.

10. The device of claim 1, further comprises:

a capacity sensor coupled to the secured storage component, wherein the capacity sensor is configured to detect a filled state of the secured storage component; and a controller coupled to the capacity sensor.

11. The device of claim 10, wherein a controller is configured to:

receive a filled signal from the capacity sensor;

generate a notification that describes the filled state of the secured storage component; and transmit the notification to an authorized user.

12. The device of claim 1, further comprising:

an enclosure encompassing the mailbox component and the secured storage component.

13. A smart and secure mailbox system comprising:

a mailbox component, wherein the mailbox component includes a door accessible to a delivery person providing a delivered mail;

a secured storage component coupled to the mailbox component through a shared section, wherein the shared section includes a weight sensor configured to generate an activation signal in response to the delivered mail;

a capacity sensor coupled to the secured storage component and controller;

an automated flap enclosed by the shared section;

a controller coupled to the weight sensor and the automated flap, wherein the controller is configured to activate the automated flap upon receiving the activation signal from the weight sensor, and wherein the capacity sensor, once activated, is configured to prevent activation of the automated flap;

one or more side panels configured to magnetically couple to an outer surface of the the secured storage component, wherein the one or more side panels completely cover the outer surface of the secured storage component; and a top panel configured to magnetically couple to a top surface of the mailbox component.

14. The system of claim 13, wherein the controller is configured to:

receive the activation signal upon a placement of the delivered mail on the weight sensor;

activate the automated flap, wherein the delivered mail falls into the secured storage component; and secure the delivered mail within the secured storage component by instructing the automated flap to close.

15. A method of managing a delivered mail securely with a smart and secure mailbox device, the method comprising:

receiving the delivered mail within the smart and secure mailbox device of claim 1, wherein a mailbox component is coupled to a secured storage component through an automated flap;

detecting an activation signal from a weight sensor integrated into the mailbox component;

activating the automated flap, wherein the delivered mail falls into the secured storage component; and securing the delivered mail within the secured storage component by instructing the automated flap to close.

* * * * *